US011441331B2

(12) United States Patent
Li et al.

(10) Patent No.: US 11,441,331 B2
(45) Date of Patent: Sep. 13, 2022

(54) WIRELESS POWER SMART DOOR LOCK

(71) Applicant: Pingchuan Li, Xiamen (CN)

(72) Inventors: Pingchuan Li, Xiamen (CN); Peng Ma, Xiamen (CN); Xiaoshun Chen, Xiamen (CN)

(73) Assignee: Pingchuan Li, Xiamen (CN)

( * ) Notice: Subject to any disclaimer, the term of this patent is extended or adjusted under 35 U.S.C. 154(b) by 613 days.

(21) Appl. No.: 16/344,716

(22) PCT Filed: Oct. 25, 2017

(86) PCT No.: PCT/CN2017/107627
§ 371 (c)(1),
(2) Date: Apr. 24, 2019

(87) PCT Pub. No.: WO2018/077179
PCT Pub. Date: May 3, 2018

(65) Prior Publication Data

US 2020/0048933 A1 Feb. 13, 2020

(30) Foreign Application Priority Data

Oct. 26, 2016 (CN) ..... 201610947765.5

(51) Int. Cl.
*E05B 47/00* (2006.01)
*E05B 49/00* (2006.01)

(52) U.S. Cl.
CPC ..... *E05B 47/0002* (2013.01); *E05B 49/006* (2013.01); *E05B 2047/0068* (2013.01)

(58) Field of Classification Search
CPC ..... E05B 47/0002; E05B 49/006; E05B 2047/0068
See application file for complete search history.

(56) References Cited

U.S. PATENT DOCUMENTS 8,487,480 B1 * 7/2013 Kesler ..... H01F 38/14 307/104
2012/0153893 A1 * 6/2012 Schatz ..... B60L 55/00 320/108

(Continued)

FOREIGN PATENT DOCUMENTS

CN 102684723 A 9/2012
CN 202831858 U 3/2013

(Continued)

*Primary Examiner* — Mark A Williams
(74) *Attorney, Agent, or Firm* — Cooper Legal Group, LLC

(57) ABSTRACT

Disclosed is a wireless power supply smart door lock, comprising: a wireless power transmission control device mounted on a door frame; the wireless power transmission control device comprises a first main control unit and a wireless power transmission coil, a first wireless power conversion unit, a first communication unit and a door body state detecting unit electrically connected to the first main control unit; the wireless power receiving control device comprises a second main control unit and a wireless power receiving coil, a second wireless power conversion unit, an energy storage unit and a second communication unit electrically connected to the second main control unit; the first main control unit detects the acquired door opening or closing state information and the energy storage unit electric quantity information obtained by the communication interaction in real time according to the door body state detecting unit, and determines whether to trigger the wireless power transmission coil to transmit electric energy to the wireless power receiving coil to charge the energy storage unit. The energy storage unit in the lock body can be charged when the door body is closed, and the energy storage unit is always fully charged to ensure the normal operation of the lock body, which greatly improves the operation convenience of the smart lock.

9 Claims, 5 Drawing Sheets

(56) References Cited

U.S. PATENT DOCUMENTS

| | | | | |
|---|---|---|---|---|
| 2012/0235502 | A1* | 9/2012 | Kesler | H03H 7/40 307/104 |
| 2012/0248887 | A1* | 10/2012 | Kesler | H02J 50/60 307/104 |
| 2012/0256494 | A1* | 10/2012 | Kesler | H02J 50/60 307/104 |
| 2012/0313742 | A1* | 12/2012 | Kurs | H03H 7/40 336/180 |
| 2013/0334892 | A1* | 12/2013 | Hall | B60L 50/20 307/104 |
| 2014/0175898 | A1* | 6/2014 | Kurs | H02J 50/70 307/104 |
| 2014/0361627 | A1* | 12/2014 | Kurs | H02J 7/025 307/104 |
| 2015/0270719 | A1* | 9/2015 | Kurs | H02J 50/60 320/108 |
| 2016/0308396 | A1 | 10/2016 | Lewis et al. | |

FOREIGN PATENT DOCUMENTS

| | | | | |
|---|---|---|---|---|
| CN | 203416033 | U | * | 1/2014 |
| CN | 203808645 | U | | 9/2014 |
| CN | 104746964 | A | | 7/2015 |
| CN | 105298245 | A | | 2/2016 |
| CN | 105896739 | A | | 8/2016 |
| CN | 205476931 | U | | 8/2016 |
| CN | 106437317 | A | | 2/2017 |
| CN | 206190038 | U | | 5/2017 |
| JP | 2013217099 | A | | 10/2013 |

* cited by examiner

WIRELESS POWER SMART DOOR LOCK

TECHNICAL FIELD

The present invention relates to a door lock system, in particular to a wireless power supply smart door lock.

RELATED ART

The existing smart door locks basically have their own battery power supply. It is necessary to pay attention to the battery power situation at all times. If the battery is wearing out, the battery needs to be replaced. The discarded battery brings great pollution to the environment; if the battery power is exhausted and it is not replaced timely, and the door is locked again, it needs to be restored by external power supply to open the door or open the door in other ways, which brings great inconvenience to the daily intelligent switching operation of the lock body. Secondly, if external power supply is required, it requires electrical contact to supply power, charging is inconvenient and unsafe.

SUMMARY OF THE INVENTION

The present invention is provided with a smart lock, which overcomes the disadvantages of the existing known technology.

The technical proposal of the present invention is that:

A wireless power supply smart door lock, wherein comprising: a wireless power emitting control device mounted on a door frame; and a wireless power receiving control device mounted on the door body;

The wireless power emitting control device comprises a first main control unit and a wireless power emitting coil, a first wireless power conversion unit, a first communication unit and a door body state detecting unit electrically connected to the first main control unit;

The wireless power receiving control device comprises a second main control unit and a wireless power receiving coil, a second wireless power conversion unit, an energy storage unit and a second communication unit electrically connected to the second main control unit;

The wireless power emitting coil and the wireless power receiving coil can be matched to perform electromagnetic interaction, the first communication unit is connected to the second communication unit and can realize the interaction of the energy storage unit power information, and the first wireless power conversion unit is configured to step down the utility power to a direct current and invert the direct current to a pulsating power source for the wireless power emitting control device, the second wireless power conversion unit is configured to convert the wirelessly received pulsating power source into a direct current power for storing energy of the energy storage unit;

The first main control unit detects the acquired door opening or closing state information and the energy storage unit electric quantity information obtained by the communication interaction in real time according to the door body state detecting unit, and determines whether to trigger the wireless power emitting coil to emit electric energy to the wireless power receiving coil to charge the energy storage unit.

In another preferred embodiment, the door body state detecting unit comprises a magnet disposed on the door body and an electromagnetic sensor disposed on the door frame, when the door body is closed, the electromagnetic sensor senses the electromagnetic information and transmits the sensing information to the first main control unit.

In another preferred embodiment, further comprising a third communication unit, the third communication unit is electrically connected to the second main control unit for communication connection with the remote main station to realize remote operation and data interaction between the remote master and the lock body.

In another preferred embodiment, further comprising a fourth communication unit electrically connected to the second main control unit for communication with a portable smart device to realize the remote operation and data interaction of the portable smart device to the lock body.

In another preferred embodiment, further comprising an identity verification unit disposed on the door body for authenticating and forming an unlock signal input to the second main control unit, the identity verification unit is electrically connected to the second main control unit.

Compared with the related art, the technical solution has the following advantages:

1. The wireless power emitting control device is disposed on the door frame, the wireless power receiving device is disposed on the door body, and the power information interaction between the two devices, the door body state detecting unit acquires the switch state information of the door body in real time, so that the energy storage unit in the lock body can be charged when the door body is closed, and the energy storage unit is always fully charged to ensure the normal operation of the lock body, which greatly improves the operation convenience of the smart lock.

2. The wireless power emitting control device and the wireless power receiving device cooperate to wirelessly charge without electrical contact, namely a contactless charging method, which is more convenient and safe.

BRIEF DESCRIPTION OF THE DRAWINGS

The present invention will now be further described with reference to the accompanying drawings and embodiments.

DETAILED DESCRIPTION OF THE EMBODIMENTS

Figure 1:
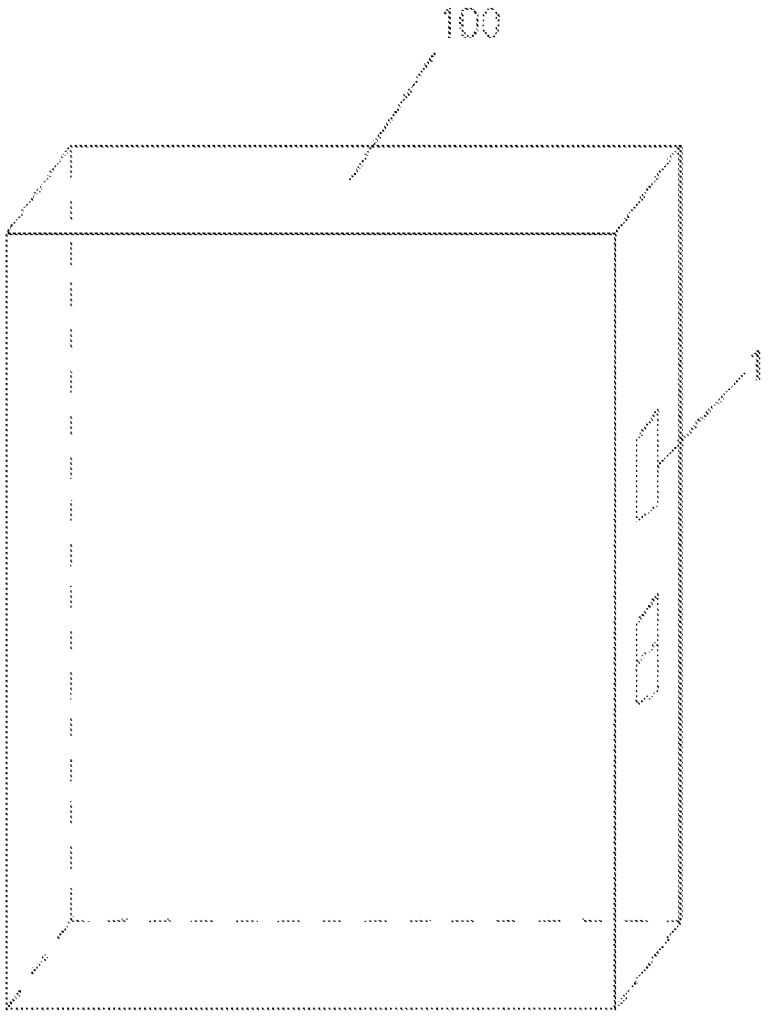
FIG. 1 is a schematic diagram of the installation of a wireless power supply smart door lock on a door frame according to embodiment 1 of the present invention.
Figure 2:
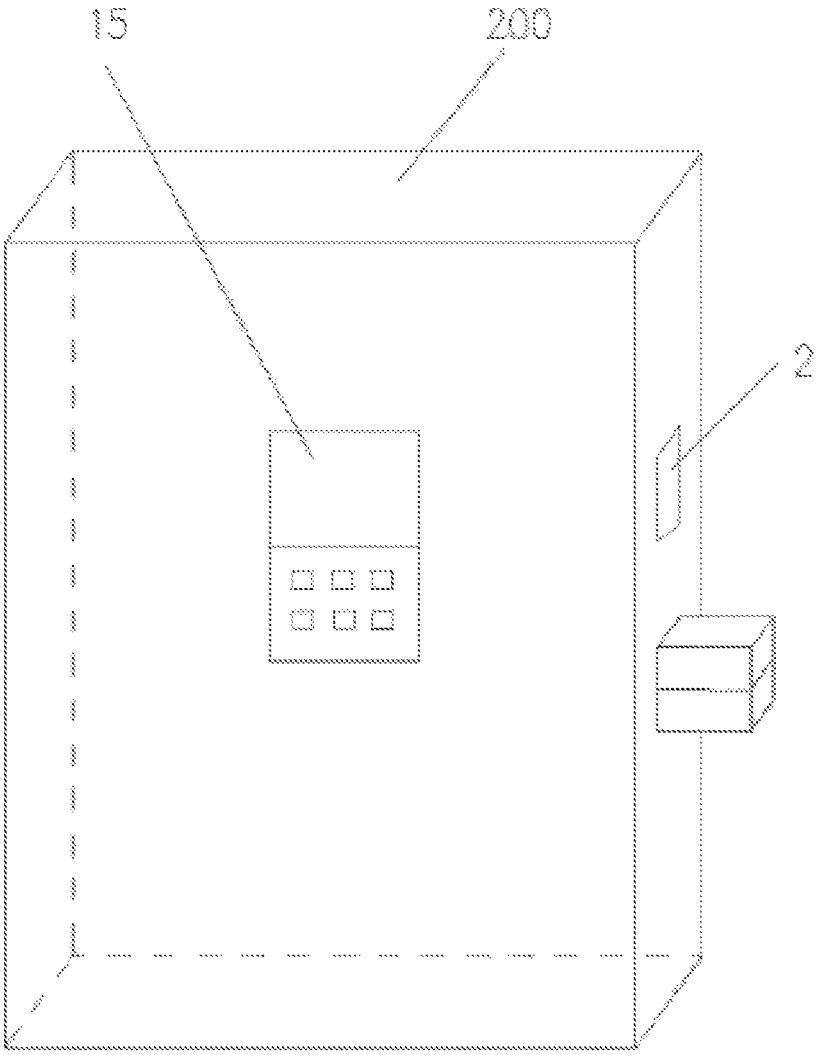
FIG. 2 is a schematic diagram of the installation of the wireless power supply smart door lock on the door body according to embodiment 1 of the present invention.
Figure 3:
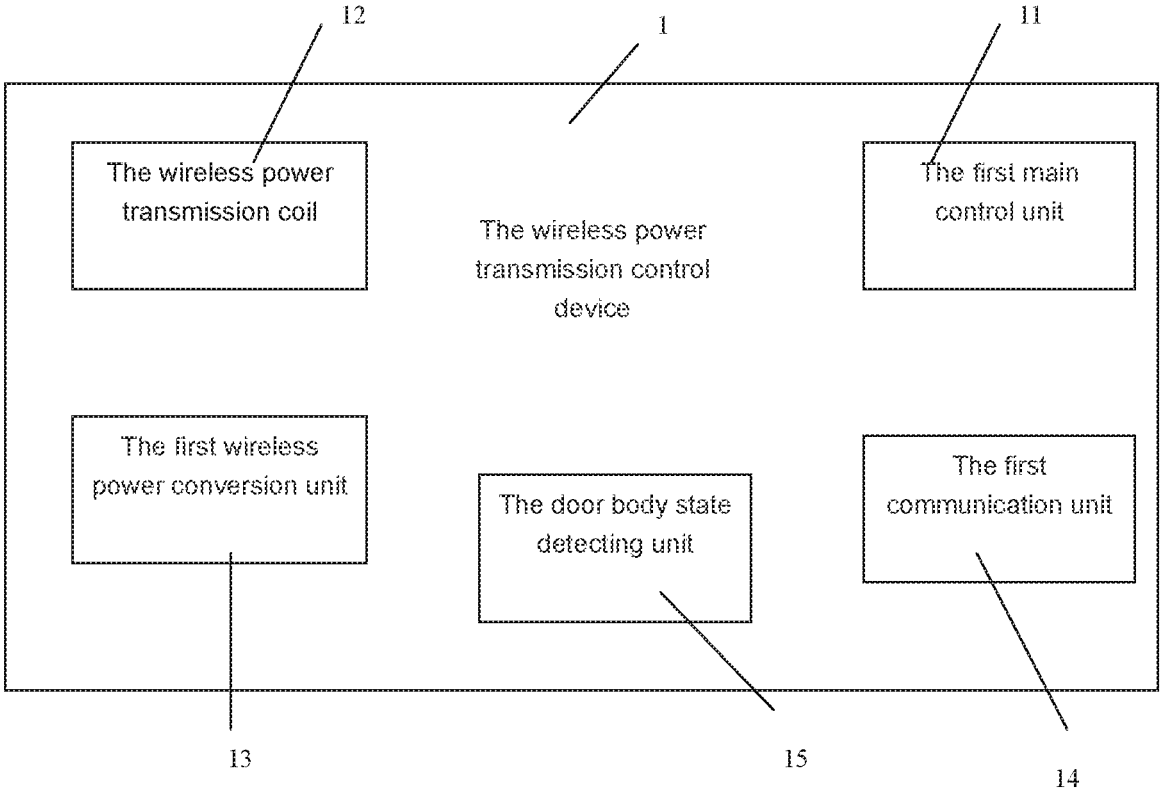
FIG. 3 is a schematic structural diagram of a wireless power emitting control device according to embodiment 1 of the present invention.
Figure 4:
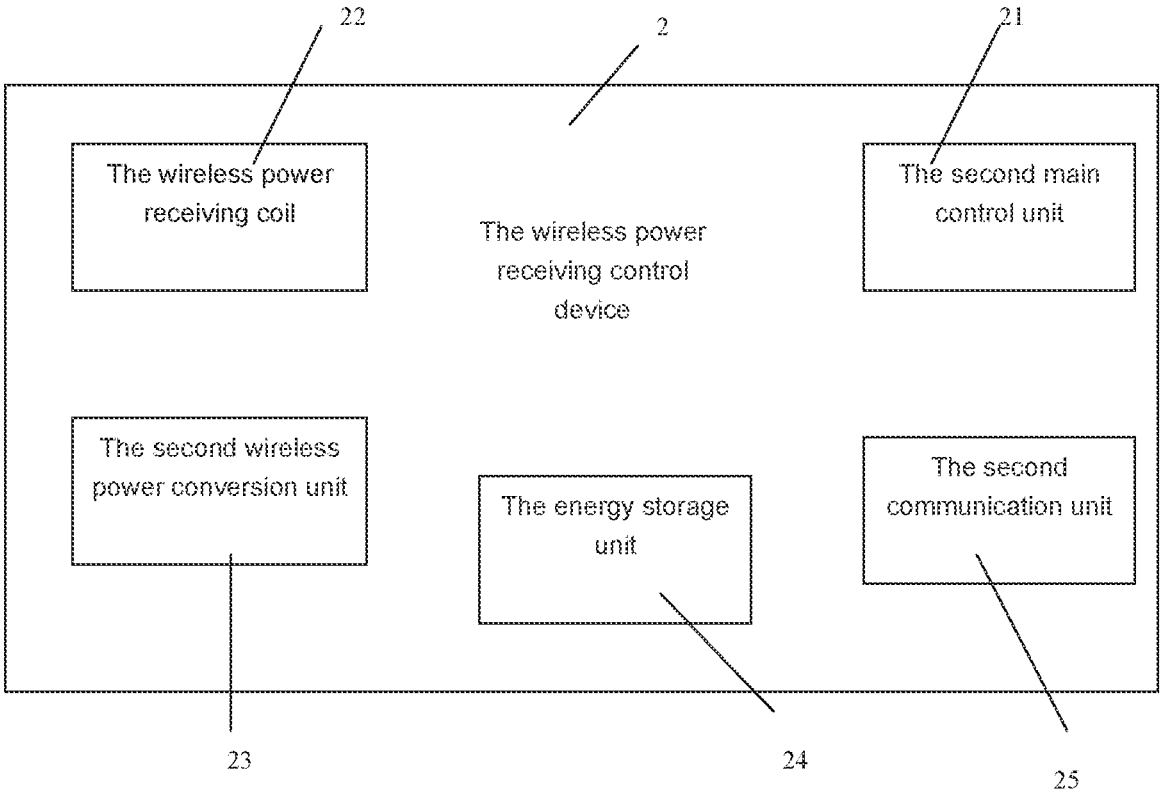
FIG. 4 is a schematic structural diagram of a wireless power receiving control device according to embodiment 1 of the present invention.
Figure 5:
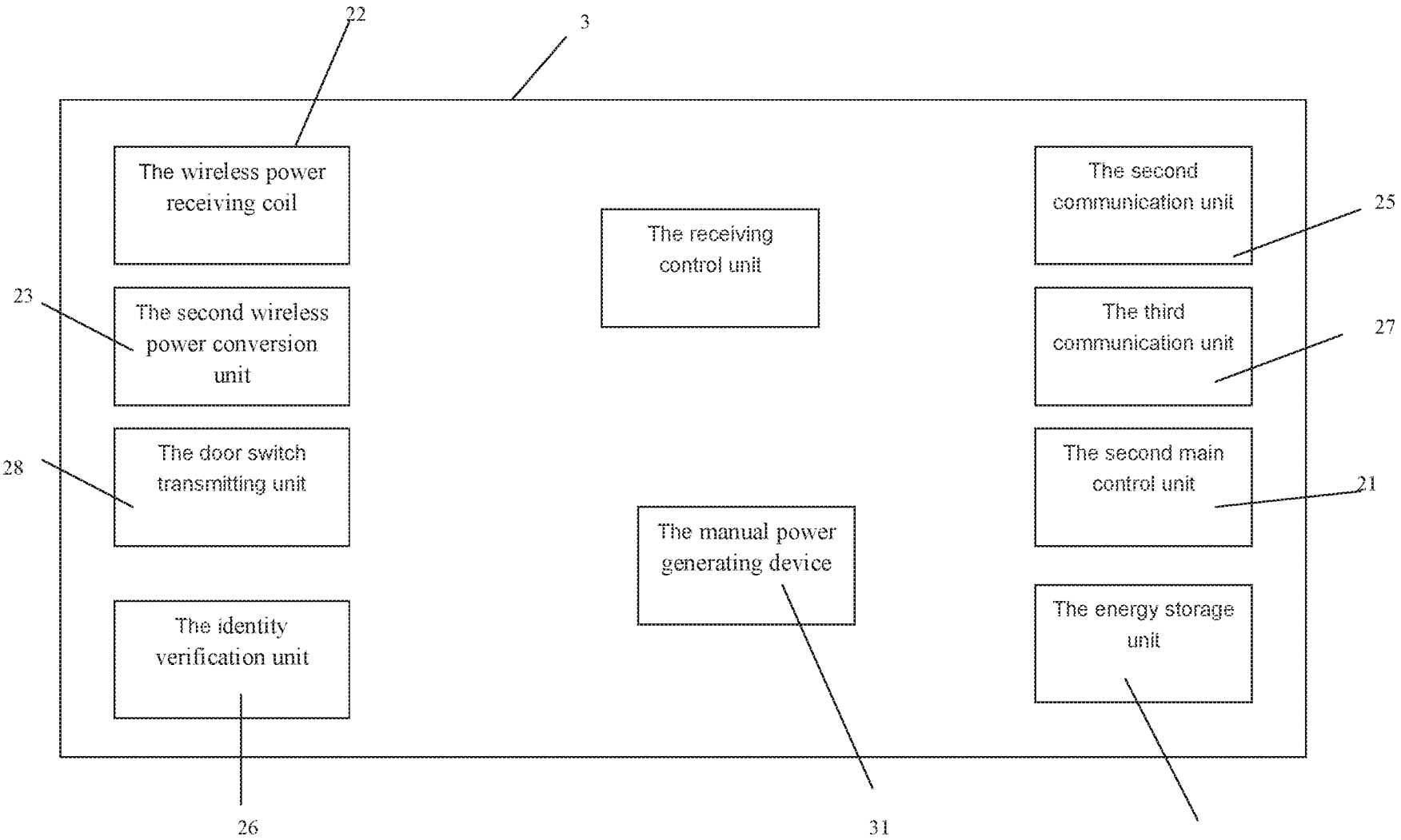
FIG. 5 is a schematic structural diagram of a wireless power receiving control device according to embodiment 2 of the present invention.

Referring to FIGS. 1-4, a wireless power supply smart door lock comprises a wireless power emitting control device 1 mounted on a door frame 100 and a wireless power receiving control device 2 mounted on the door body 200.

The wireless power emitting control device 1 comprises a first main control unit 11 and a wireless power emitting coil 12, a first wireless power conversion unit 13, a first communication unit 14 and a door body state detecting unit 15 electrically connected to the first main control unit 11;

The wireless power receiving control device 2 comprises a second main control unit 21 and a wireless power receiving coil 22, a second wireless power conversion unit 23, an energy storage unit 24 and a second communication unit 25 electrically connected to the second main control unit 21;

In this embodiment, the door frame 100 specifically refers to the inner position of the door frame, and the door body 200 specifically refers to the side position of the door body corresponding to the inner side of the door frame;

The door body state detecting unit 15 is electrically connected to the first main control unit 11, the wireless power emitting coil 12 and the wireless power receiving coil 22 can be matched to perform electromagnetic interaction, the first communication unit 14 and the second communication unit 25 are signal connected to realize the interaction of the power information of the energy storage unit, the first wireless power conversion unit 13 is configured to step down the commercial power to a direct current and invert the direct current to pulsating power source for the wireless power emitting control device 1, the second wireless power conversion unit 23 is configured to convert the wirelessly received pulsating power into a DC power for the energy storage unit. In this embodiment, the first communication unit 14 and the second communication unit 15 are wireless communication units, and may adopt infrared, NFC, or the like;

The first main control unit 11 detects the on or off state information of the door body 200 and the power information of the energy storage unit 24 according to the communication interaction in real time and determines whether to trigger the wireless power emitting coil to emit electric energy to the wireless power receiving coil to charge the energy storage unit 24.

Preferably, the door body state detecting unit 15 comprises a magnet disposed on the door body and an electromagnetic sensor disposed on the door frame. When the door body is closed, the electromagnetic sensor senses an electromagnetic signal and sends the sensing information to the first main control unit 11. The detection mode of the door body state detecting unit 15 is not limited thereto, and can also be realized by a mechanical stroke switch trigger signal or other Hall device electromagnetic induction.

Preferably, the wireless power supply smart door lock further comprises a third communication unit (not shown), and the third communication unit is disposed on the door body 200 and electrically connected to the second main control unit 21 for communication connection with a remote main station to realize the remote operation and data interaction of the remote main station to the lock body. The third communication unit is a wireless communication unit, and can be realized by using a communication method such as GPRS or WIFI.

Preferably, the wireless power supply smart door lock further comprises a fourth communication unit (not shown), and the fourth communication unit is disposed on the door body 200 and electrically connected to the second main control unit 21 for use with the portable smart The communication connection of the device realizes the remote operation and data interaction of the portable smart device to the lock body, and the portable smart device can be a mobile phone, a palmtop computer, a tablet computer or other handheld smart machine, and the fourth communication unit can be realized by using Bluetooth communication mode.

Preferably, the wireless power supply smart door lock further comprises an identity verification unit 26 for authenticating and forming an unlock signal input to the second main control unit 21, the identity verification unit 26 is disposed on the door body 200 and connected to the second main control unit 21. The identity verification unit 26 can be a fingerprint verification module, a password verification module, or the like.

When the door is closed, the door body state detecting unit 15 detects that the door body is closed and transmits the state information to the first main control unit 11, and the first main control unit 11 obtains the electric quantity information of the energy storage unit 24 through the data of the second communication unit 25 and the first communication unit 14. When two conditions of the door body being in the off state and the power shortage are satisfied, the first main control unit 11 triggers the first power conversion unit 13 and the wireless power emitting coil 12 to supply power to the wireless power reception coil 22, and the wireless power receiving coil 22 converts the received energy into DC power by the second power conversion unit 23 to charge the energy storage unit 24; when the power of the energy storage unit 24 is full, the wireless power emitting control device 1 stops operating. When the door body 200 is opened, the wireless power emitting control device 1 on the door frame 100 also stops operating.

The wireless power supply smart door lock according to the present invention can lock the body in a power state every time to unlock, and can normally switch the lock, thereby reducing the battery usage of the smart lock in the prior art and reducing environmental pollution due to the waste battery, thereby greatly improving the convenience of the lock. Secondly, the present invention adopts a wireless power emitting control device to cooperate with a wireless power receiving device for wireless charging, and does not require electrical contact connection, namely a contactless charging method, which is more convenient and safe.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

INDUSTRIAL APPLICABILITY

The present invention is provided with a wireless power supply smart door lock that the energy storage unit in the lock body can be charged when the door body is closed, and the energy storage unit is always fully charged to ensure the normal operation of the lock body, which greatly improves the operation convenience of the smart lock. The present invention has wide range of applications and well industrial applicability.

The invention claimed is:

1. A wireless power smart door lock, comprising:

a wireless power emitting control device configured to be mounted on a door frame, a wireless power receiving control device configured to be mounted on a door body, and an identity verification unit configured to be disposed on the door body for identity verification and configured to form a signal for unlocking the wireless power smart door lock to be input into a second control unit, wherein:

the wireless power emitting control device comprises a first control unit, a wireless power emitting coil, a first wireless power conversion unit, a first communication unit and a door body state detecting unit, the wireless power emitting coil, the first wireless power conversion unit, the first communication unit, and the door body state detecting unit are electrically connected to the first control unit, the wireless power receiving control device comprises the second control unit, a wireless power receiving coil, a second wireless power conversion unit, an energy storage unit, and a second communication unit, the wireless power receiving coil, the second wireless power conversion unit, the energy storage unit, and the second communication unit are electrically connected to the second control unit, the wireless power emitting coil is configured to be matched with the wireless power receiving coil to perform electromagnetic interaction, the first communication unit is in signal communication with the second communication unit to achieve power information interaction of the energy storage unit, the first wireless power conversion unit is configured to step down utility power to a direct current and invert the direct current to a pulsating power source for the wireless power emitting control device, the second wireless power conversion unit is configured to convert the pulsating power source wirelessly received into a direct current power for the energy storage unit to store as energy, the first control unit detects acquired open state information or close state information of the door body and electric quantity information of the energy storage unit obtained by communication interaction in real time by the door body state detecting unit and determines whether to trigger the wireless power emitting coil to emit electric energy to the wireless power receiving coil to charge the energy storage unit according to the electric quantity information of the energy storage unit, and the identity verification unit is electrically connected to the second control unit.

2. The wireless power smart door lock according to claim 1, wherein:

the door body state detecting unit comprises a magnet configured to be disposed on the door body and an electromagnetic sensor configured to be disposed on the door frame, and when the door body is closed, the electromagnetic sensor senses electromagnetic information and transmits sensing information obtained by the electromagnetic sensor to the first control unit.

3. The wireless power smart door lock according to claim 1, comprising:

a third communication unit, wherein:

the third communication unit is electrically connected to the second control unit for signal communication between the second control unit and a remote station to achieve remote operation and data interaction between the remote station and the wireless power smart door lock.

4. The wireless power smart door lock according to claim 1, comprising:

a fourth communication unit, wherein:

the fourth communication unit is electrically connected to the second control unit for signal communication between a portable smart device and the second control unit to achieve remote operation and data interaction between the portable smart device and the wireless power smart door lock.

5. The wireless power smart door lock according to claim 1, comprising:

a manual power generating device, wherein:

the manual power generating device is configured to be mounted on the door body and electrically connected to the energy storage unit.

6. The wireless power smart door lock according to claim 5, wherein the energy storage unit is a rechargeable lithium battery or a super capacitor.

7. The wireless power smart door lock according to claim 5, wherein an operating portion of the manual power generating device is a handle of the door body.

8. The wireless power smart door lock according to claim 3, comprising:

a fourth communication unit, wherein:

the fourth communication unit is electrically connected to the second control unit for signal communication between a portable smart device and the second control unit to achieve remote operation and data interaction between the portable smart device and the wireless power smart door lock.

9. A wireless power smart door lock, comprising:

a wireless power emitting control device configured to be mounted on a door frame, a wireless power receiving control device configured to be mounted on a door body, and, a manual power generating device, wherein:

the wireless power emitting control device comprises a first control unit, a wireless power emitting coil, a first wireless power conversion unit, a first communication unit, and a door body state detecting unit, the wireless power emitting coil, the first wireless power conversion unit, the first communication unit, and the door body state detecting unit are electrically connected to the first control unit, the wireless power receiving control device comprises a second control unit, a wireless power receiving coil, a second wireless power conversion unit, an energy storage unit, and a second communication unit, the wireless power receiving coil, the second wireless power conversion unit, the energy storage unit, and the second communication unit are electrically connected to the second control unit, the wireless power emitting coil is configured to be matched with the wireless power receiving coil to perform electromagnetic interaction, the first communication unit is in signal communication with the second communication unit to achieve power information interaction of the energy storage unit, the first wireless power conversion unit is configured to step down utility power to a direct current and invert the direct current to a pulsating power source for the wireless power emitting control device, the second wireless power conversion unit is configured to convert the pulsating power source wirelessly received into a direct current power for the energy storage unit to store as energy, the first control unit detects acquired open state information or close state information of the door body and electric quantity information of the energy storage unit obtained by communication interaction in real time by the door body state detecting unit and determines whether to trigger the wireless power emitting coil to emit electric energy to the wireless power receiving coil to charge the energy storage unit according to the electric quantity information of the energy storage unit, and the manual power generating device is configured to be mounted on the door body and electrically connected to the energy storage unit.

* * * * *